United States Patent [19]

Ströszynski

[11] 3,973,961

[45] Aug. 10, 1976

[54] PROCESS AND APPARATUS FOR THE MANUFACTURE OF A SERIES OF PHOTOCONDUCTOR WEBS

[75] Inventor: Joachim Ströszynski, Naurod, Taunus, Germany

[73] Assignee: Hoechst Aktiengesellschaft, Frankfurt am Main, Germany

[22] Filed: June 6, 1975

[21] Appl. No.: 584,692

[52] U.S. Cl. ..... 96/1.5; 118/410; 118/603

[51] Int. Cl.[2] ..... G03G 5/04; B05C 3/02

[58] Field of Search ..... 96/1.5; 118/3, 410, 118/407, 411

[56] References Cited

UNITED STATES PATENTS 2,933,061 4/1960 Galer ..... 118/3

*Primary Examiner*—John D. Welsh

*Attorney, Agent, or Firm*—Richard L. Schwaab

[57] ABSTRACT

Disclosed is a process for the manufacture of a series of photoconductor webs spaced apart from each other on a carrier web by electrically conductive spacing strips extending transversely of the carrier web, comprising (a) transporting a carrier web having an electrically conductive surface disposed thereon in a feed direction across a backing member and in close proximity to a slot die arranged transversely to the feed direction; (b) pumping a photoconductive coating solution into the slot die; (c) flowing the photoconductive solution intermittently from the slot die orifice onto the carrier web for periods of time sufficient to produce the spaced photoconductor webs, the flow of the coating solution being substantially uniform during each coating period and the entire quantity of coating solution required for each coating photoconductor web being extruded from the slot die orifice in the form of a substantially uniform stream; (d) maintaining the distance between the carrier web and the die orifice constant and so small that the coating solution issuing from the die orifice forms a bridge between the orifice of the slot die and the carrier; and (e) drying the coated material. Also disclosed is an apparatus for carrying out the foregoing process.

5 Claims, 3 Drawing Figures

PROCESS AND APPARATUS FOR THE MANUFACTURE OF A SERIES OF PHOTOCONDUCTOR WEBS

BACKGROUND OF THE INVENTION

The present invention relates to a process for the manufacture of a series of photoconductor webs, by coating an electrically conductive surface disposed on a carrier web with a solution containing a photoconductive substance and drying the web. Coating is effected in the form of coated sections separated from each other by spacing strips extending transversely to the axis of the carrier web. Further, the invention relates to an apparatus for performing a preferred embodiment of the inventive process.

Web-shaped carriers coated with photoconductor layers are used in electrophotographic copying apparatuses. Electrically conductive papers, films, fabrics and metal foils may be used as carrier webs, metal-coated plastic films being preferred because of their high dimensional stability and good flexibility. During their use in a copying apparatus, the photoconductive layers are subject to a higher or lower degree of wear, because for each copy toner must be scattered onto the photoconductive surface. For this reason, a relatively large number of photoconductor layers of the required length are stored in the copying apparatus in the form of a photoconductor web rolled up in a film magazine in the manner of a photographic film. In order to provide a definite zero potential, which is required for the charge to leak off during exposure of the charged photoconductor layer, a contact surface of adequate size must be provided for grounding the conductive carrier. Two alternatives exist to provide a metallic contact with the grounding, viz. to leave a strip extending along one or both edges of the photoconductive web uncoated with photoconductor, or to provide one, or preferably both, ends of the photoconductively coated sections with contact strips extending transversely to the longitudinal axis of the photoconductor web.

Particularly in the case of metallized plastic films the production of the contact surfaces offers problems. Metal strips extending along the web and left uncoated have the disadvantage that sliding contacts must be provided to enable the charge to leak off, and that such sliding contacts are sensitive and prone to trouble and do not allow for a quick, reliable discharge because the contact surfaces are relatively small. Therefore, photoconductor webs are preferred which have adequately sized contact areas extending over their entire widths at both ends of each photoconductively coated section. So far, no process has become known by which photoconductor webs having such contact areas may be manufactured in series, i.e., in the form of a large number of webs connected with each other to form a coherent row from which individual photoconductor webs may be obtained by severing between the coated sections.

U.S. Pat. No. 2,933,061 describes an apparatus by means of which a smooth, uniform layer may be applied to a web of paper or similar material conveyed at a uniform speed in its longitudinal direction. This known device is equipped, inter alia, with a slot die and a rotary backing roller. The slot die serves to apply a coating solution, and the backing roller serves as a support for the web while the coating solution is applied. The backing roller is mounted so that it rotates about its horizontal axis and the slot die is arranged in such a manner that its orifice is parallel to the axis of the backing roller and may be moved close to the surface of the backing roller and removed therefrom. The slot die is equipped with a die chamber in which the coating liquid to be applied is stored. The die chamber may be connected with a device my means of which its contents of coating solution are constantly replenished. When the slot die is moved into the position where it is close to the backing roller, the die orifice is open, whereas it is closed by a lamella or a similar closing device when the slot die is away from the backing roller. This apparatus may thus be used for applying to a web of material coated sections interrupted by the desired spacings. The apparatus is practically unsuitable, however, for the manufacture of a series of photoconductor webs, because it does not allow the application of layers, the thickness of which can be adjusted with an adequate degree of accuracy. Above all, it is almost impossible, when using this known coating device, to prevent the layer from turning out slightly thicker at the beginning of the coated sections. Such thicker areas are of particular disadvantage because they produce permanent marks in the metallic surface of the coated webs when these are wound into rolls, and the marks are then reflected as defects in the copies produced by means of this photoconductor layer.

SUMMARY OF THE INVENTION

It is an object of the present invention to provide a process for the manufacture of a series of photoconductor webs which fulfills the high demands which must be made of photoconductive layers to be used for copying processes and which, in particular, avoids or considerably reduces the above described disadvantages.

For achieving this object, there has been provided a process for the manufacture of a photoconductor web in which an electrically conductive surface disposed on a carrier web is coated with a solution containing a photoconductive substance and is then dried, the coating being applied in the form of coated sections separated by spacing strips extending transversely to the direction of feed of the carrier web. The section-wise coating of the carrier web is affected while the web is being transported at a constant speed in its longitudinal direction and while it is positioned on a section of the surface of a rotating backing roller, by conducting the web in this position past and only a short distance away from the orifice of a slot die arranged transversely to the web and causing the coating solution to flow for adequate periods of time from the slot die onto the sections to be coated, the flow of coating solution being substantially uniform during each coating period. The process which is the object of the present invention is characterized, however, in that the coating solution is pumped into the slot die and that the entire quantity of coating solution required for one coated section is extruded from the die orifice in the form of a substantially uniform stream and that the distance between the carrier web and the die orifice is maintained constant and so small, that the coating solution issuing from the die orifice forms a bridge between the orifice of the slot die and the carrier web. Advantageously, the process is conducted in such a manner that the slot die is arranged beneath the backing roll, in the so-called 6 o'clock position, and the coating solution is ejected upwards.

By the simplest embodiment of the inventive process, section-wise coated photoconductor webs of adequate quality are obtained which meet most quality standards. For higher demands, however, it may be necessary to improve the uniformity of the coating. A considerable improvement is achieved by a method for conducting the inventive process according to which the entire quantity of coating solution required for coating one section is ejected from the die orifice in the form of a main stream and a side stream, the main stream being ejected as a uniform stream from the die orifice as long as one particular section is coated, whereas the side stream, which comprises only a small proportion of the total quantity of solution, is ejected from the die orifice at the beginning of the main stream and in addition to it, thus accelerating the formation of a bridge of coating solution between the slot die orifice and the carrier web. The additional solution which is pumped into the slot die for the purpose of building the bridge and which is ejected from the orifice as a side stream, may amount to a quantity such that a transition zone of 0.5 to 2.0 cm length is formed until the final uniform thickness of the layer is attained. If the transition zone has a length of 1 cm, for example, the side stream may be ejected for a period of 1/5 to 1/10 second. Due to the accelerated formation of the bridge, the process can be performed within a shorter time and the coating applied is more uniform, especially at the beginning of the coated sections. In this embodiment, too, the slot die is preferably mounted in the 6 o'clock position.

In some cases, the above described methods may produce irregularities in the coating on the coated sections, which become apparent as continuous or interrupted streaks and the stria oriented in the direction of feed of the web, or as fine holes in the layer which are caused by tiny air bubbles that had been enclosed in the coating solution and burst after coating. Such coating defects are far less frequent when a stream of coating liquid is passed through the slot die during the application of the coating solution onto the sections to be coated. Thus, in this embodiment of the inventive process, more coating liquid is pumped into the slot die than is ejected from the slot of the die onto the sections to be coated. The excess coating liquid is allowed to drain at some other point of the slot die. The coating liquid is supplied to the slot die and drained therefrom at such locations that at least part of the excess of coating liquid is flowing past all points of the slot die, over its entire width. This can be achieved in many ways, and the coating liquid may be fed into and discharged from the slot die at more than one point, if desired, and the current produced when supplying and draining the liquid in more than one place may flow in the same direction or in opposite directions. It is considered most advantageous to direct a stream of excess coating solution through the slot die in such a manner that the coating solution is supplied to one front end of the slot die and drained at the other, so that a stream of coating solution is produced which flows lengthwise through the slot die in one direction, from one end to the other end. It is advisable to pump off the excess coating liquid at the draining point. The efficiency of the draining pump must be adapted to the quantity of excess coating solution used, and a dosing pump may be employed, for example, for pumping off excess liquid. It was found that a process in which the application of the coating solution and its quantity are controlled in accordance with the rhythm of the coating periods produces coated sections of the desired length with particular accuracy, if, at the beginning of the coating period, the pipe supplying the coating solution to the slot die is opened before opening the discharge opening at the suction pump arranged in the discharge pipe of the slot die, and if, at the end of the coating operation, the supply pipe is closed before closing the discharge pipe.

If, in the embodiment of the inventive process in which excess coating solution is passed through the slot die, part of the quantity of coating solution required for the application to the sections to be coated is discharged from the slot die in the above described manner, as a side stream, this has the advantage that the entire quantity of coating solution required is already available at the beginning of each coating period. Thus, a very uniform formation of the coating is achieved at the beginning of each section to be coated, so that the full thickness of the layer is achieved within a very short time and remains highly constant thereafter.

In all of the above described embodiments, the process is advantageously carried out in such a manner that the stream or streams of coating solution pumped to the slot die flow not only during the actual coating process, but all the time, even during the breaks between the different coating operations. In order to guarantee the supply of streams to the slot die in accordance with the invention, the constantly flowing streams of coating solution are fed to the die or interrupted at exactly the right moments. If the process is carried out with excess of coating solution, a suction pump having the pumping capacity necessary for pumping off the excess of coating solution during a coating period is caused to act constantly on the discharge pipe of the slot die. The discharge pipe of this suction pump may be permanently open or alternately opened and closed. If it is temporarily closed, the discharge pipe is shut off either at the end of the coating period or shortly (for example 1/10 second) thereafter, and the discharge pipe is opened either at the beginning of the coating operation or shortly (for example 1/10 second) thereafter. During the intervals between the coating periods, the streams of coating solution disconnected from the supply to the slot die circulate within the dosing pump, for example in a by-pass.

If the discharge pipe of the suction pump connected with the discharge side of the slot die remains constantly open or if it is closed only after the coating streams are disconnected from the slot die, it is no problem to arrange the slot die in any desired position relative to the backing roller without any risk, and coating may be effected from above (12 o'clock position of the slot die), because, since the action of the suction pump is prolonged beyond the end of the coating operation, the die is emptied and no uncontrolled quantities of coating solution can be discharged.

It is another object of the invention to provide an apparatus which is particularly suitable for carrying out the embodiment of the inventive process in which, during each coating period, a stream of coating solution flows through the slot die. As already mentioned at the beginning, no process for the production of a series of photoconductor webs has become known so far in which photoconductor layers are applied to a carrier web in the form of coated sections. This object is achieved by providing a coating apparatus which comprises a horizontal, revolvable backing roller, a slot die which extends parallel to it, the orifice of which is arranged directly in front of the outer surface of the backing roller, at least one infinitely variable dosing pump which is arranged in the supply pipe for the slot die, and one or more slide valves arranged between the dosing pump or each dosing pump and the slot die and capable of being operated without causing displacement. The apparatus according to the invention, by which the present object is achieved, is particularly characterized by a second, infinitely variable dosing pump and a slide valve connected to the discharge side of the dosing pump and capable of being operated without causing displacement. The supply pipe enters the slot die at one of its front lateral edges and a discharge pipe leaves the slot die at the opposite edge, the latter leading into the entry side of the infinitely variable dosing pump. The slide valves which are capable of being operated without causing displacement and which form part of the apparatus, are known per se. The expression "capable of being operated without causing displacement" means that pipes may be opened or closed by the operation of these slide valves without causing part of the liquid contained in the slide valve to enter the opened or closed pipes, even when all the hollow spaces of the slide valve are filled with liquid.

Depending on the position of the slot die relative to the backing roller and on the viscosity of the coating solution, the apparatus preferably comprises at least one dosing pump which is connected to the supply pipe of the slot die and is also connected with a slide valve capable of being operated without causing displacement and which is used for the conveyance of the above-mentioned side stream or side streams.

Other objects, features and advantages of the present invention will become apparent from the detailed description of preferred embodiments which follows, when taken together with the attached figures of drawing.

BRIEF DESCRIPTION OF THE DRAWINGS

FIGS. 1*a* and 1*b* show an apparatus for carrying out the inventive process, wherein FIG. 1*a* is a schematic wiring diagram;

FIG. 1*b* is a diagrammatic representation of the apparatus; and

DETAILED DESCRIPTION OF PREFERRED EMBODIMENTS

Figure 1A:
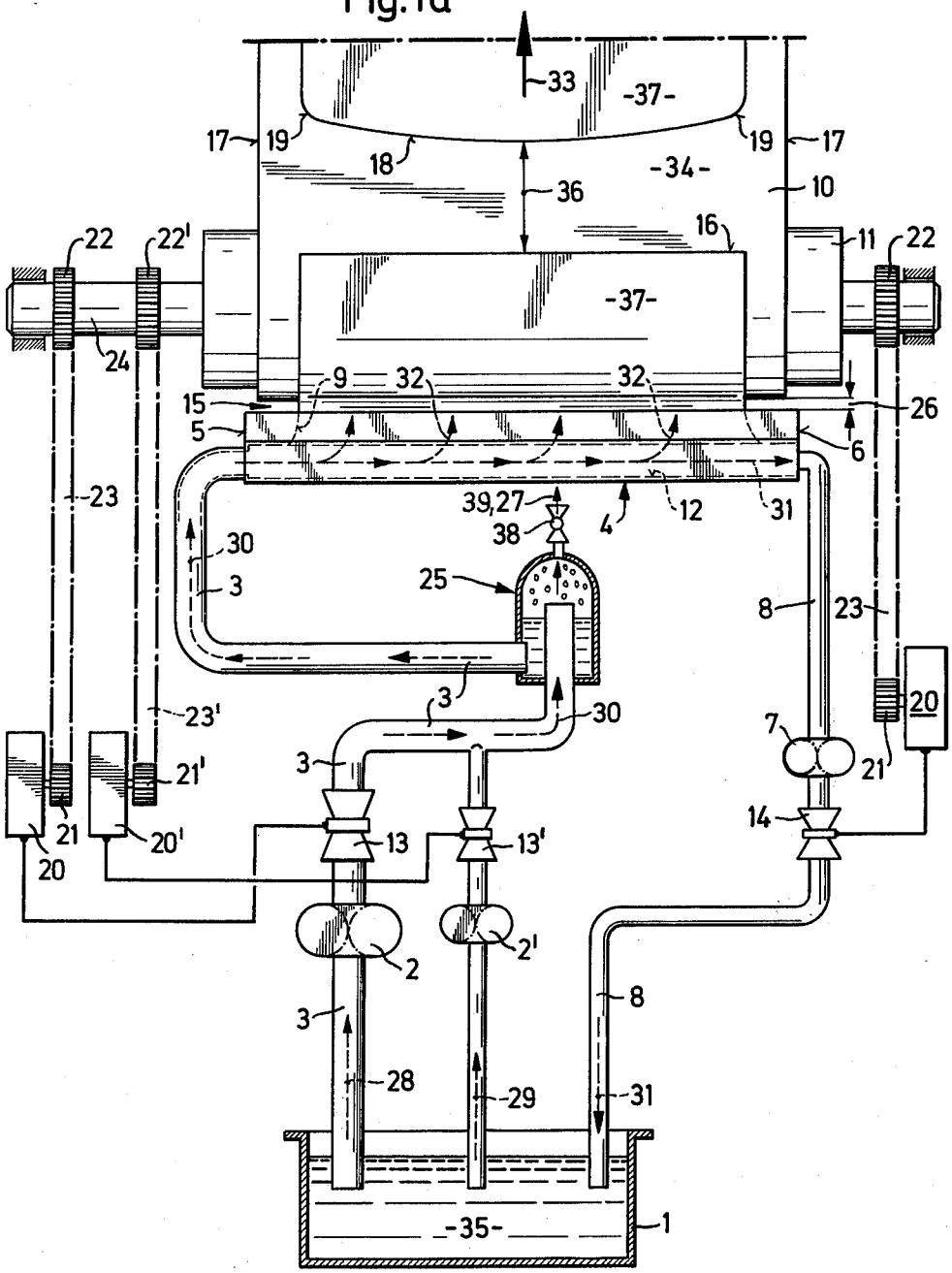
Figure 1B:
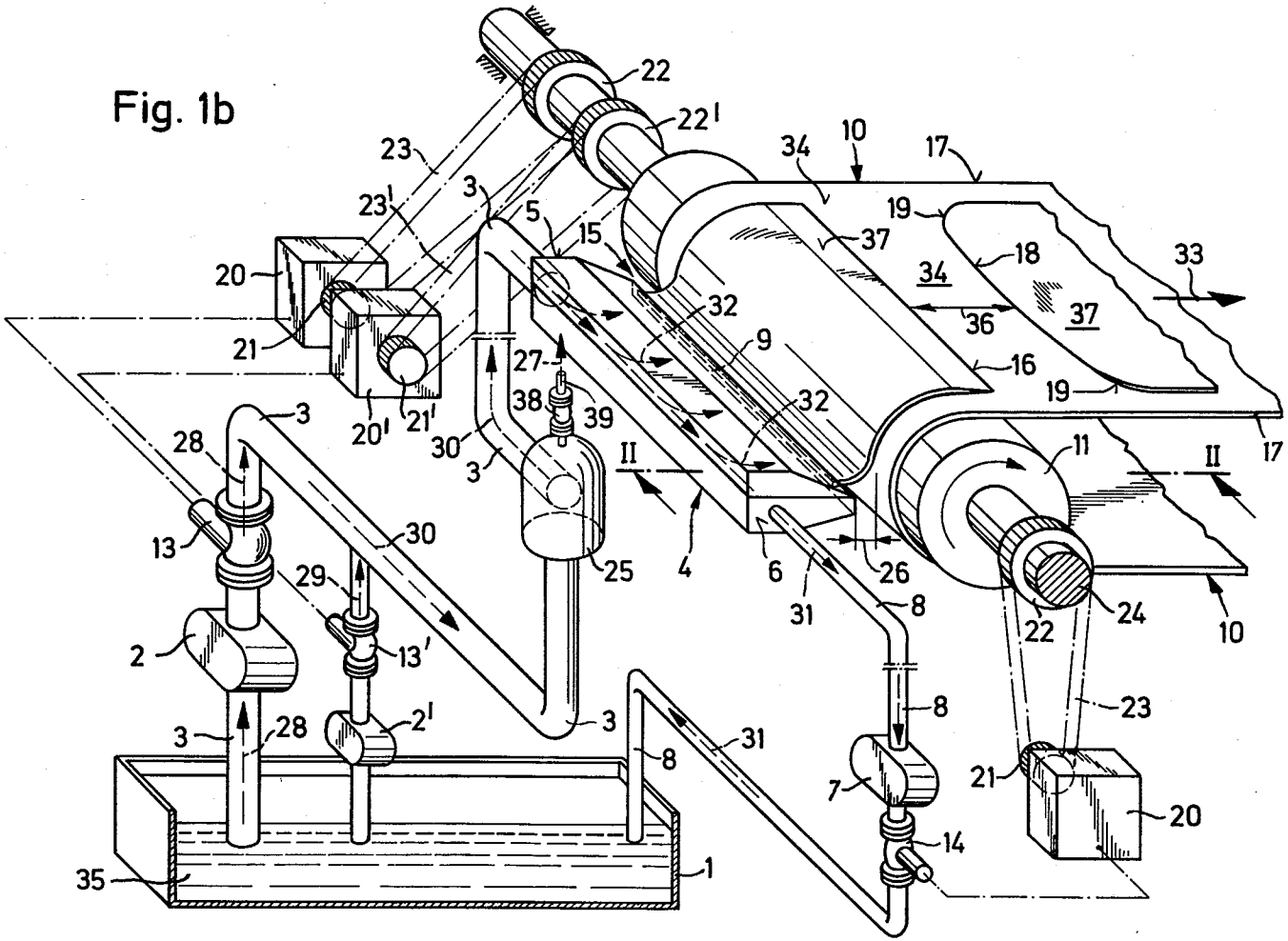
Figure 2:
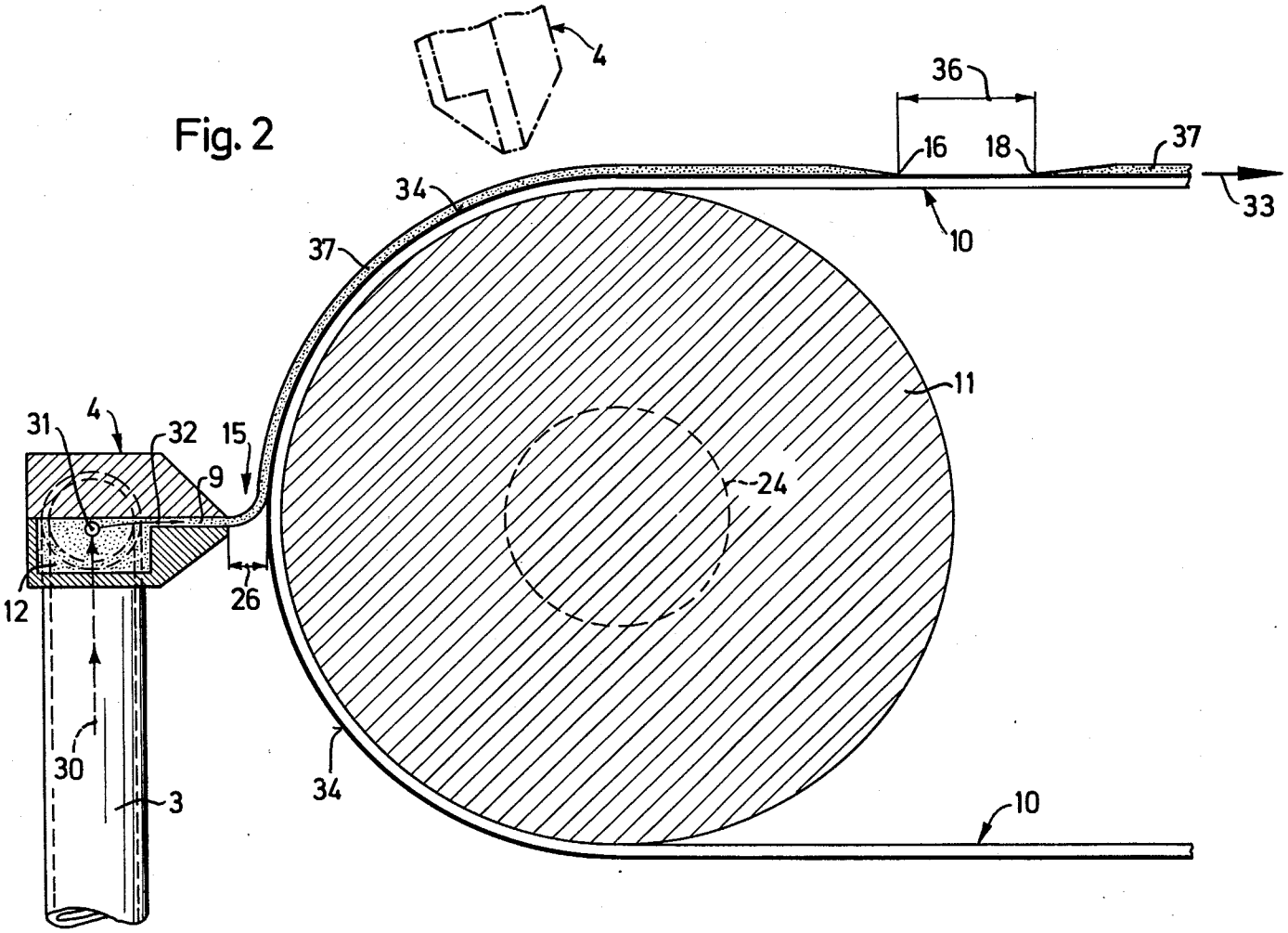
FIG. 2 is a side view of a detail of the apparatus of FIGS. 1*a* and 1*b* on a larger scale, as a section along the plane II—II in FIGS. 1*a* and 1*b*.

When the apparatus shown in FIGS. 1*a* and 1*b* is used, an exactly defined quantity of the coating solution 35 is fed during the coating operation from a storage tank 1 via a first dosing pump 2, capable of being operated without causing displacement, and a supply pipe 3 to the front end 5 of the slot die 4 in the form of a stream 28. At the opposite front end 6, a smaller but also exactly defined quantity of coating solution in the form of a partial stream 31 is discharged from the slot die 4 via the infinitely variable dosing pump 7 and the discharge pipe 8 and is returned to the storage tank 1 for further use. A cycle is thus formed in which, during the coating process, an exactly predetermined quantity of coating medium flows constantly through the slot die in the longitudinal direction. The difference between the supplied quantity of coating solution and the discharged quantity, i.e., the stream 32, which corresponds to the desired coating weight of the coating being produced, is applied to the carrier web 10 via the slot 9 of the slot die 4. During this process, the carrier web 10 is continuously passed in the direction 33 over a rotating backing roller 11 which is arranged directly in front of the slot die 4. The 6 o'clock position of the slot die 4 shown in FIG. 1*a* was chosen only in order to simplify the drawing. Of course, while the slot die may take any desired position, preferably it is used in the 9 o'clock to 12 o'clock positions (see FIG. 2), so that any air bubbles which may be present in the coating solution collect in the chamber 12 of the slot die 4 and can be discharged from the slot die 4 together with the issuing coating solution. The desired length of the coating process is achieved by the timed operation of slide valves 13 and 14, which are capable of being operated without causing displacement. At the beginning of the coating operation, slide valve 14 located in the discharge pipe 8 before the dosing pump 7 remains closed until the coating solution is available in the coating zone 15 for being transferred onto the carrier web 10. The solution (stream 30) is fed via the supply pipe 3 and the first dosing pump 2 through the opened slide valve 13 into the slot die 4. The thickness of the coating zone 15 is determined by the distance 26 between the slot die 4 and the carrier web 10 and is about 0.1 to 0.3 mm. When the coating solution touches the electrically conductive surface 34 of the carrier web 10, the slide valve 14 opens at once in order to guarantee that the exactly defined quantity of coating medium passes the slot die 4 in the longitudinal direction during the entire coating operation and that only the quantity representing the difference between the amount of solution supplied and the amount discharged, i.e., the stream 32, is ejected through the slot 9 and used for coating. Thereby, the coating assumes a front boundary line 16 which is exactly at right angles with the edges 17 of the carrier web 10. In most cases, the desired coating thickness is reached after 2 to 10 mm, the thickness of the layer increasing steadily up to this point (see FIG. 2), as can be distinctly seen in the case of colored coating solutions where the coloration of the coating becomes increasingly deeper. The end of the coating process proceeds in the inverse order, as compared with the above description. The further supply of coating solution is interrupted by the closure of the slide valve 13, whereas the slide valve 14 remains open for a short time and is then closed, too, thus enabling the second dosing pump 7 to suck off a small amount of solution from the slot die 4 while the slide valve 14 is still in the open position. In this manner, the supply of coating solution from the slot die 4 to the carrier web 10 in the coating zone 15 is stopped abruptly. The thickness of the coating decreases with the closing of the slide valve 13, and when a coating thickness of zero is reached, the coated section ends in a convexly curved rear boundary line 18 which, towards the left and right hand sides, changes into lines 19 which extend in a direction slightly oblique to the edges of the carrier web. The convex rear boundary line 18 of the coated section and the fact that the coating thickness decreases over a length of up to 30 mm are caused by the viscosity of the coating medium and the quantity thereof present in the coating zone 15 and are also a function of the selected distance between the slot die 4 and the carrier web 10.

The timely operation of the slide valve 13 is controlled by a timer 20. Via a toothed belt pulley 21 and a belt 23, the timer receives pulses from a toothed belt pulley 22 mounted on the shaft 24 of the backing roller, the number of the pulses being proportional to the number of revolutions carried out by the shaft 24.

A bubble catcher 25 is installed in the supply pipe of the slot die 4, so that air 27 may escape from the coating solution through a valve 38 and the discharge pipe 39.

If the above mentioned side stream 29 is used in the inventive process, the supply pipe 3 of the apparatus contains an additional dosing pump 2' equipped with a displacement free slide valve 13', which is controlled by the timer 20', pulleys 21' and 22' and a belt 23'. In this manner, additional coating solution may be supplied to the slot die 4 at the beginning of the coating operation, especially in such cases where coating solution continues to be sucked off from the slot die 4 by the dosing pump 7 after the end of the coating process and even during the intervals between coating operations, because the slide valve 14 is opened or no slide valve is provided, so that the discharge pipe remains constantly open. Such a measure may prove necessary especially in the case of coating solutions of low viscosity and in the case of die arrangements between the 9 0'clock and the 12 o'clock positions, in order to prevent the slot die 4 otherwise filled with coating medium from an uncontrolled emptying onto the carrier web 10. Thus, the additional dosing pump 2' serves the purpose of rapidly feeding additional coating solution to the die 4 emptied by the dosing pump 7, when the coating process begins. The additional quantity supplied is also controlled in the above described manner by opening and closing the slide valve 13' at the right moments.

It is one of the advantages of the process according to the invention that a sharply defined boundary line extending over the entire width of the carrier marks the beginning of the coated section. The front boundary lines extend very accurately at right angles to the edges of the carrier web. Furthermore, a thickening of the coated layer, in particular at the beginning of the coating, need not be feared, so that permanent, undesirable distortions during winding-up are also avoided. On the contrary from the line 16 marking the beginning of the coated section, up to the point where the final coating thickness is reached, the thickness of the coating increases steadily and then decreases steadily towards the line 18 which marks the end of the coated section. Between the rear boundary line 18 of one coated section and the front boundary line 16 of the following coated section, there is a spacing 36 which is uncoated.

The embodiment of the process in which, in addition to the coating stream 32 required for actual coating, a second — side — stream 31 flows continuously through the die during the coating operation, has the further advantage that, over the entire length of the coating, the coated photoconductive layer 37 is uniform and completely homogeneous, i.e., free from streaks, striae, and holes. In addition thereto, this process is very economical, because the excess of coating solution flowing off in the direction 31 may be recovered and used again for coating without loss.

It goes without saying that the statements made above are also valid if the coating solution consists of a liquid which, in addition to components dissolved therein or in place of such components, contains finely distributed solid or liquid particles which are not dissolved in the liquid.

I claim:

1. A process for the manufacture of a series of photoconductor webs spaced apart from each other on a carrier web by electrically conductive spacing strips extending transversely of the carrier web, comprising the steps of:

a. transporting a carrier web having an electrically conductive surface disposed thereon in a feed direction across a backing member and in close proximity to a slot die arranged transversely to said feed direction;

b. pumping a photoconductive coating solution into said slot die;

c. flowing said photoconductive solution intermittently from the orifice of said slot die onto said carrier web for periods of time sufficient to produce said spaced photoconductor webs, the flow of said coating solution being substantially uniform during each coating period and the entire quantity of coating solution required for each coated photoconductor web being extruded from said slot die orifice in the form of a substantially uniform stream;

d. maintaining the distance between the carrier web and the die orifice constant and at such a small magnitude that the coating solution issuing from the die orifice forms a bridge between the orifice of the slot die and the carrier web; and e. drying the coated carrier web.

2. The process as defined in claim 1, wherein said step of flowing the photoconductive solution from the slot die comprises extruding from said slot die for each quantity of photoconductive solution required for one photoconductor web section a main stream and a secondary stream said main stream said main stream being extruded as a uniform stream over the entire coating period for one photoconductor web section and said secondary stream comprising a minor porportion of said quantity of photoconductive solution and being extruded for only a short time interval at the beginning of extrusion of said main stream, whereby formation of said bridge of coating solution is accelerated.

3. The process as defined by claim 1, wherein during each coating operation a predetermined quantity of coating solution is pumped into the slot die in such a manner that the supply within the die remains constant and wherein the process further comprises the step of simultaneously removing a predetermined, but smaller quantity of coating solution from the slot die for the same period of time, the difference between the quantity of coating solution pumped into the slot die and the quantity removed therefrom constituting the quantity of coating solution extruded from the slot die orifice as a substantially uniform stream.

4. The process as defined by claim 3, wherein during at least each coating operation a quantity of coating solution in excess of that flowing from the slot die orifice onto the carrier web is pumped into said slot die at one forward transverse edge thereof and said excess quantity is continually drawn out of said slot die from the opposite forward lateral edge of the die.

5. The process as defined by claim 4, wherein said excess quantity of coating solution is pumped into the slot die only during each coating operation and excess coating solution is constantly drawn out of the slot die.

* * * * *

UNITED STATES PATENT OFFICE

CERTIFICATE OF CORRECTION

Patent No. 3,973,961 Dated August 10, 1976

Inventor(s) Joachim Stroszynski

It is certified that error appears in the above-identified patent and that said Letters Patent are hereby corrected as shown below:

Please correct the spelling of the inventor's name, "Stroszynski" (by removing the umlaut);

After line 21, please insert the foreign Application data:
-- [30] Foreign Appln. Priority Data
June 7, 1974 Germany P 24 27 515.8 --;

In column 7, line 11, please insert a hyphen between "displacement" and "free".

In column 8, line 36, cancel "said main stream", second occurrence.

Signed and Sealed this

Seventeenth Day of May 1977

[SEAL]

*Attest:*

RUTH C. MASON
*Attesting Officer*

C. MARSHALL DANN
*Commissioner of Patents and Trademarks*